United States Patent [19]

Christophel

[11] 4,018,210

[45] Apr. 19, 1977

[54] FORCED AIR CONVECTOR/HEATER FIREPLACE GRATE STRUCTURE

[75] Inventor: Reuben L. Christophel, Harrisonburg, Va.

[73] Assignee: Shenandoah Manufacturing Company, Inc., Harrisonburg, Va.

[22] Filed: Aug. 28, 1975

[21] Appl. No.: 608,740

[52] U.S. Cl. ..... 126/164; 165/174; 239/523; 417/312

[51] Int. Cl.[2] ..... F23H 13/00

[58] Field of Search ..... 126/121, 163, 164, 165; 98/40 N, 40 C; 165/174; 138/DIG. 4, 37, 39; 239/518, 523; 417/312; 237/51

[56] References Cited

UNITED STATES PATENTS

| | | | |
|---|---|---|---|
| 2,164,629 | 7/1939 | Sibley | 165/174 X |
| 3,482,506 | 12/1969 | Bruns | 98/40 C |
| 3,799,703 | 3/1974 | Paine et al. | 417/312 |
| 3,901,212 | 8/1975 | Stites | 126/121 |
| 3,905,351 | 9/1975 | Hatfield et al. | 126/121 |

FOREIGN PATENTS OR APPLICATIONS

| | | | |
|---|---|---|---|
| 978,392 | 12/1964 | United Kingdom | 126/121 |

*Primary Examiner*—Ronald C. Capossela
*Attorney, Agent, or Firm*—Mason, Fenwick & Lawrence

[57] ABSTRACT

A forced air convector and heating fireplace grate structure formed of an array of substantially C-shaped hollow tubes arranged in parallel vertical planes providing a forwardly facing concave cradle for supporting burning logs or other fuel. A motor driven fan and an associated plenum transversely spanning the array of tubes and communicating with the lower inlet ends thereof provide a pressurized appropriately distributed air supply to the tubes to effect heating of the air in the tubes by the burning fuel and achieve forced discharge of the heated air in predetermined directions back into the room.

4 Claims, 6 Drawing Figures

Fig-1
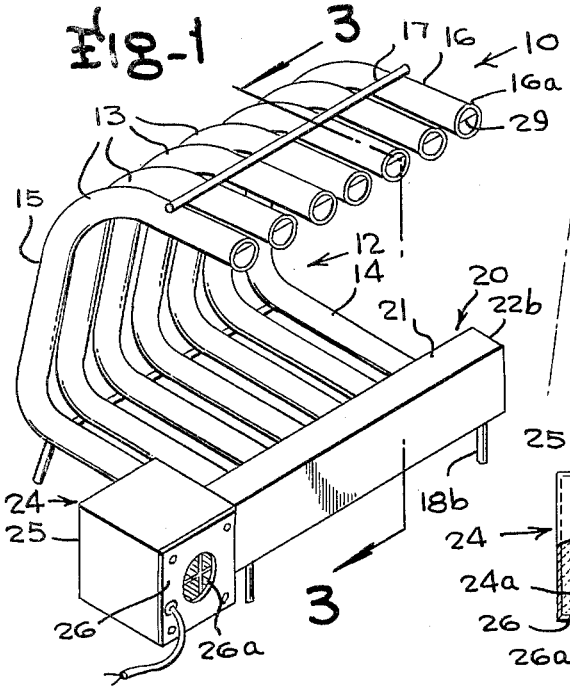
Fig-2
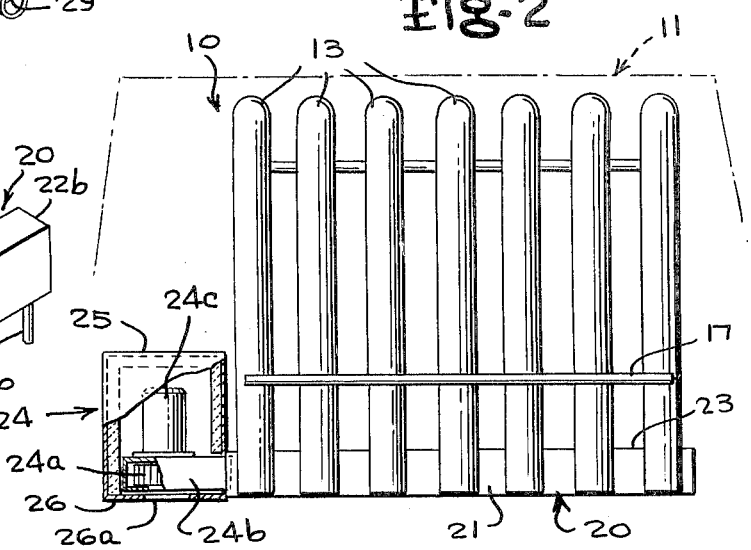
Fig-3
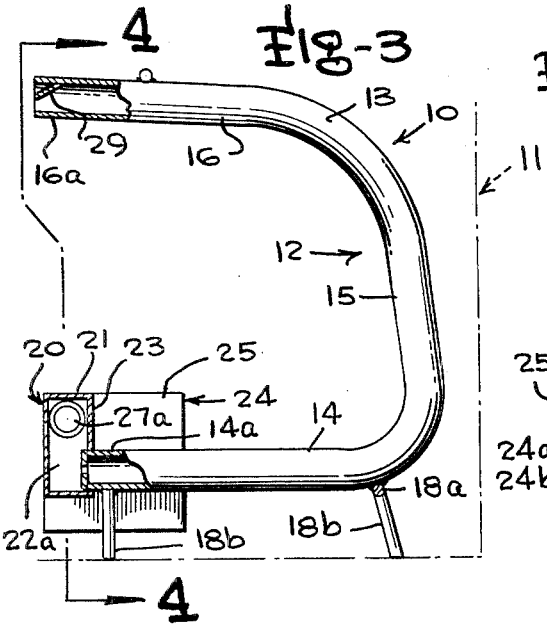
Fig-4
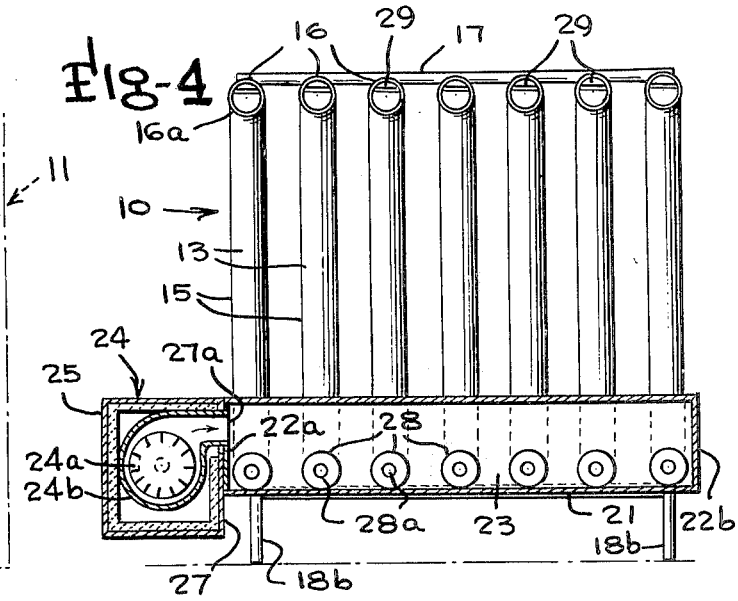
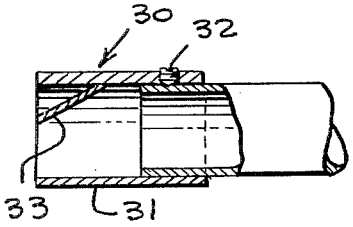
Fig-5
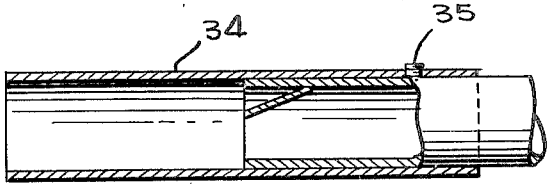
Fig-6

FORCED AIR CONVECTOR/HEATER FIREPLACE GRATE STRUCTURE

BACKGROUND AND OBJECTS OF THE INVENTION

The present invention relates in general to fireplace grate devices for wood or coal fuel or solid fuel of similar form, and the like and having means for enhancing transfer of heat from the burning fuel to the air in the room or living space served by the fireplace, and more particularly to a forced-air, heat-exchanging fireplace grate structure having a plurality of generally U-shaped or C-shaped hollow tubes arranged in vertical planes forming a supporting cradle for the wood or coal fuel and having a pressurized plenum and motorized fan system for achieving forced air convection of air through the tubes in close heat exchange relationship with the heat of the burning fuel.

A number of fireplace grate type structures have been devised for supporting burning fuel such as wood, coal or other solid fuel and having air conveying tubes formed by the grate members for receiving air from the room to be served by the fireplace grate structure, passing the air through the tubes in good heat exchange relation with the burning fuel, and discharging the air back into the room to enhance the heating efficiency. Typical of these are prior U.S. Pat. Nos. 1,030,002 to Livingston, 1,313,085 to Greene, 1,608,745 to Holbek, and 1,747,259 to Pierce, all of which employ a plurality of hollow tubular members arranged in a generally L-shaped configuration having a lower leg provided with an air inlet to receive air from the room and conduct the same rearwardly, and then upwardly and forwardly about the burning fuel to achieve better heating of the air, and then discharge the heated air back into the living space. These devices all, however, merely rely upon convention currents produced by the heating of the air in the tubular members to draw room air into the lower legs of the tubular members and achieve air circulation movement rearwardly, upwardly and forewardly through the members to discharge back into the room. No pressurized plenum or motor driven fan for achieving forced circulation of room air through the tubes of such devices is proposed in any of these patents.

Horizontally arranged tubular log or solid fuel supporting structures have been proposed, in conjunction with motor driven fans for circulating the air through some kind of underlying tubular duct structure located wholly at the bottom of a fireplace. However, these devices do not effect a pressurized supply of appropriately distributed pressurized air from a pressurized plenum or manifold to a plurality of vertical substantially C-shaped or U-shaped air heating and discharging tubes.

An object of the present invention is the provision of a fireplace grate device formed of a plurality of vertically arranged hollow air conveying and heating tubes curved in a forewardly facing concave pattern to define a cradle for logs or other fuels, for use with existing fireplaces which will not alter the fireplace structure and yet will significantly enhance the heating efficiency of the fireplace.

Another object of the present invention is the provision of a novel fireplace grate structure of the type described in the proceeding paragraph, wherein a pressurized manifold and associated motor driven fan is incorporated in the fireplace grate unit and communicates with air inlet openings at the lower ends of the tubes to properly distribute pressurized air to the lower inlets of the tubes to be heated during passage through the tubes and discharged in desired directions back into the room to be heated, eliminating the need for any motorized air supply systems located externally of the fireplace and connected to the grate structure.

Other objects, advantages and capabilities of the present invention will become apparent from the following detailed description, taken into conjunction with the accompanying drawings illustrating preferred embodiments of the invention.

BRIEF DESCRIPTION OF THE FIGURES

FIG. 1 is a perspective view of the fireplace grate structure constructed in accordance with a preferred embodiment of the present invention;

FIG. 2 is a top plan view of the fireplace grate structure, with parts of the fan housing broken away to reveal the interior thereof;

FIG. 3 is a vertical section view taken along the line 3—3 of FIG. 1;

FIG. 4 is a vertical section view taken along the lines 4—4 of FIG. 3;

FIG. 5 is a fragmentary section view illustrating a telescopically assembled rotatable baffle sleeve supported on the upper discharge end of one of the plurality of hollow air conveying and heating tubes, which may be used with the fireplace grate of the present invention; and FIG. 6 is a fragmentary vertical section view through a telescopically associated extension sleeve which may be assembled on the upper ends of each of the hollow air conveying and heating tubes to adapt the fireplace grate for use with abnormally deep fireplaces.

BRIEF DESCRIPTION OF PREFERRED EMBODIMENTS

Referring to the drawings, wherein like reference characters designate corresponding parts throughout the several figures, the fireplace grate structure of the present invention is indicated generally by the reference character 10, which is adapted to the disposed wholly within the fireplace recess or chamber, indicated generally at 11 in FIGS. 2 and 3 and comprises generally a multi-tube cradle portion 12 shaped to form a forwardly facing concave cradle structure of distorted U-shaped or C-shaped configuration to support logs or other forms of wood fuel or coal fuel or other solid fuels thereon. The multi-tube cradle portion 12 is formed of an array of hollow elongated tubes or pipes 13 bent as best illustrated in FIG. 3 to provide a lower substantially horizontal straight leg 14 terminating in an inlet end **14*a* at the forward end thereof and joined at its rearmost end along a smoothly curving path to a vertically rising rear leg 15 which is inclined slightly forward of a vertical plane at the rear of the array of tubes. The rear leg 15 joins along another smoothly curved portion a top leg 16 which is very slightly inclined upwardly from the horizontal and extends forwardly to a discharge end 16*a* which is projected forwardly, or outwardly of the fireplace chamber, from the vertical plane through the inlet end 14*a* of the lower horizontal leg 14. The substantially C-shaped or forwardly concavely curved tubes 13** are disposed in parallel vertical planes in side-by-side relation and rigidly held in such an array by transverse bracing members.

For example, the tubes 13 are rigidly held in side-by-side spaced relation along the top legs 16 by the bracing rod 17, and are held in properly spaced positions at the bottom by leg structures 18 which may, as in the illustrated embodiment, comprise U-shaped rod members having a horizontal transverse upper leg 18*a* similar in length and size to the bracing rod 17 spot welded or otherwise secured to bottom surface portions of the lower leg sections 16 and having downwardly extending leg portions 18*b* at the opposite ends of the upper rod portion 18*a*.

A pressurized air supply plenum or manifold 20 formed of an elongated, box-like tubular duct structure 21 of rectangular cross-section having closed opposite end walls 22*a* and 22*b* transversely spans the array of air conveying and heating tubes 13 defining the cradle portion 12, and having a rear wall 23 provided with openings sized in conformity with the outer diameter of the tubes 13 to receive the inlet end portions of the tubes therein and be welded thereto where the tube walls pass through the apertures in the rear wall 23 to seal the rear wall 23 to the tube walls. The plenum or manifold structure 20 provides a pressurized sealed plenum connected to the lower inlet portion of each of the tubes 13 which, when in operation, is pressurized by a side mounted blower or fan structure, indicated generally by the reference character 24, housed in the box-like fan housing 25 fixed to one end of the plenum or manifold 20.

The housing 25 is a box-shaped structure formed of sheet metal walls or the like, lined with suitable insulation rated for approximately 2300° F. to protect the contents of the box against the heat of the fire from the fuel supported by the cradle portion, and has a front wall 26 having an air intake opening 26*a* to receive air from the room and permit it to pass into the center portion of the impeller or rotor 24*a* of a fan such as a squirrel cage type fan of conventional commercial construction surrounded by a conventional scroll indicated at 24*b*. The outlet portion of the scroll, which is usually of spiral configuration, connects to and terminates at an outlet opening 27*a* in the side wall 27 of the fan housing which communicates with the interior of the plenum or manifold 20 at one end thereof and provides the air passage for pressurizing the manifold. In one embodiment, one of the end walls, for example the end wall 22*a*, of the plenum may be fixed, as by spotwelding, to the side wall 27 of the fan housing 25 with the outlet opening 27*a* extending through the side wall 27 and the overlying end wall 22*a*, to facilitate mounting the fan housing on either the left-hand or right-hand end of the plenum 20. This renders the fan housing readily reversible from one end of the plenum to the other, so that it can be positioned at the side of the grate unit nearest the existing electrical outlet, if only one outlet is adjacent the fireplace, so that the electrical supply cord can go directly to the outlet without crossing the fireplace. The motor, indicated as 24C, for the fan 24 occupies most of the remainder of the fan housing 25 and is protected from damage due to heat by the insulation lining the fan housing.

The shaped air convector tubes or pipes 13 are open at both ends for flow of air therethrough, but are adapted to accomplish a desired distribution of air flow through the tubes and a desired direction of discharge of air from the upper exit ends of the tubes. To this end, the lower inlet ends 14*a* of the tubes 13 are provided with sized apertured annular regulating orifice members 28, for example, formed of annular discs welded in the inlet end portions of the tubes, each having a center opening 28*a* of appropriate size to control the rate at which pressurized air flows from the plenum 20 into the associated tube in direct relation to the cross sectional area of the opening or orifice 28*a* therein. In one example, the openings or orifices 28*a* are each about three-fourths of an inch (1.905 centimeters) in diameter. In such an arrangement wherein the size of the orifices 28*a* is uniform, the greater velocity of air flow appears to occur through the tubes nearest the center of the grate, which is desirable as this tends to be the hottest region.

Positioned within each of the outlet end portions of the shaped hollow tubes or pipes 13 is an air discharge directing baffle 29 to direct the flow of the heated air emerging from the exit end 16*a* of each of the tubes along a downwardly inclined path to enhance warming of the room air nearest the floor. The air directing discharge baffles 29 in the embodiment illustrated in FIGS. 1 to 4 are simply in the form of a truncated elliptical disc of flat sheet metal shaped to correspond to the curvature of the inner surface of the associated tube which intersects the inclined plane in which the baffle 29 lies which is inclined at an angle to the axis of the associated upper leg portion 16 of the tube in the manner generally indicated in FIG. 3.

It will be apparent that when the fireplace grate structure as previously described is located in a conventional fireplace such as indicated at 11, with the concavely curved tubes forming the multi-tube cradle portion 12 opening outwardly to the front of the fireplace, and solid fuel such as wood, coal or the like is positioned on the cradle portion and is undergoing combustion, air from the room will be drawn in through the air intake opening 26*a* of the fan housing 26 and will be discharged by the impeller 24*a* through the scroll 24*b* to pressurize the plenum 20 and provide appropriate pressurized air supply to achieve properly distributed air inflow through the orifice member openings 28*a* into the inlet end of the shaped air-conveying tubes or pipes 13. The air passing through the lower legs 14 of the air-conveying and heating tubes 13 is heated as it passes into close proximity to the fuel burning on the cradle portion to be heated by thermal transfer from the burning fuel. This heated air curves upwardly into the vertically rising rear legs 15 of the associated tubes 13 and then curves upwardly and forwardly through the adjoining top leg portions 16 and is forcibly discharged from the exit ends 16*a* of the tubes along downwardly and outwardly inclined discharge paths determined by the angular deflectors 29. The sizing and distribution of the holes or apertures 28*a* in the orifice member 28 at the tube inlet ends insures a proper distribution of air flow through the plurality of air conveying tubes 17 so that substantially uniform heating is achieved in the plurality of tubes.

In some circumstances, it may be desired to adjust the angle or direction of the heated air being discharged from the upper outlet ends of the tubes 17, so that some lateral deflection or diversion of the heated air is produced at the tubes nearest the opposite ends of the unit. To this end, a telescoping rotatable baffle sleeve unit, indicated generally by the reference character 30, as shown in FIG. 5, may be assembled on the outlet ends of each of the air conveying tubes 17 instead of providing the stationary baffles 29 in the tubes. The telescopically assembled rotatable baffle sleeve unit 30 comprises a cylindrical tubular sleeve member 31 having an inner diameter corresponding substantially to the outer diameter of the associated tube 13 and having an axial length of several inches so as to provide an appropriate amount of overlap, for example about 1 inch or more overlap, over the outlet end of the associated tube 13. The overlapping portion of the sleeve member 31 may be provided with a threaded or tapped aperture receiving a threaded set screw 32 therein to fix the sleeve member 31 at any desired position of angular adjustment on the associated tube 13. The discharge end portion of the sleeve member 31 is provided with a baffle 33 similar in construction and configuration to the baffle 28, welded within the sleeve member 31 along its periphery and inclined relative to the axis of the sleeve member 31 in a manner similar to the inclined position of the baffle 28. It will be apparent that by providing a set of such telescopically assembled rotatable baffle sleeve units 30 on the discharge or outlet ends of the plurality of tubes 13, the endmost baffle sleeve units can be rotated to direct their associated baffles 33 in a manner to direct the heated air being discharged from the associated tube 13 in an outwardly inclined as well as a downwardly inclined manner to cause the discharged air streams to, in effect, fan out from the set of tubes 13 and improve the distribution of heated air into the room.

Similarly, if the unit is to be employed in a fireplace which is somewhat deeper than conventional fireplaces, a telescopically associated extension sleeve, as indicated generally by the reference character 34, shown in FIG. 6, may be provided for each of the tubes 13, to be telescopically assembled on the upper air discharge or outlet end **16*a* of each tube 13. Such extension sleeves 34 may be, for example, about 6 inches long, and preferably are of relatively thin tube stock having an inner diameter corresponding to the outer diameter of the associated tubes 13. As in the case of the baffle sleeve units 30, the extension sleeves 34 will also have a tapped or threaded opening in each sleeve near the rearmost end thereof receiving a threaded set screw 35 to fix the extension sleeve in telescopically assembled position on the associated tube 13.**

What is claimed is:

1. A forced-air room air convector and heating fireplace grate structure, comprising a plurality of hollow curved metallic tubes of substantially C-shaped configuration disposed in side-by-side alined relation in parallel vertical planes rigidly assembled in an array defining a forward facing concave cradle structure to be placed in outwardly facing relation in a fireplace chamber and support solid fuel on lower leg portions of the cradle structure, the tubes being correspondingly shaped to each define a lower horizontal leg extending rearwardly from a forward air inlet end and rearwardly joining a rear upwardly extending leg which upwardly joins a forwardly extending top leg terminating in an air outlet opening spaced above the air inlet opening, an elongated duct manifold forming a plenum transversely spanning the array of hollow tubes adjoining the inlet ends of the tubes and in gaseous communication therewith, an air propelling fan means rigidly supported by the grate structure adjacent one end of the plenum within the fireplace chamber for withdrawing ambient air from a room served by the fireplace and propelling the air into the plenum to pressurize the latter and provide a pressurized air supply to the inlet ends of the tubes for conveyance through the tubes in heat exchange relation to fire burning in the cradle structure and discharge the heated air in predetermined downwardly inclined paths back into the room, and means for directing along downwardly inclined paths the flow of heated air emerging from the outlet openings of the hollow tubes comprising a truncated oval baffle disc supported inside the open outlet end of each tube in a plane which extends through the horizontal diameter of the surrounding tube portion and is inclined downwardly and outwardly relative to the axis thereof with the curved edge portions of the disc which form the oval portion thereof engaging and joined to the inner surface of the associated hollow tube and the truncated edge thereof disposed substantially in a vertical plane alined with the outlet end of the associated tube.

2. A forced-air room air convector and heating fireplace grate structure as defined in claim 1, wherein said fan means for supplying a forced flow of ambient room air to said hollow tubes comprises a box-like fan housing having a rotary fan inside the housing including a rotatable impeller adapted to withdraw a forced draft of ambient air into said housing, the housing having a first opening enabling the ambient room air to be drawn toward the fan impeller, a motor for driving said fan impeller, and the housing having a second opening in gaseous communication with said plenum through which air is delivered from the housing to the plenum to pressurize the plenum.

3. A forced-air convector and heating fireplace grate structure as defined in claim 2, wherein said fan housing includes insulated rated to about 2300° F. lining the housing about the motor to protect the latter against heat damage.

4. A forced-air convector and heating fireplace grate structure as defined in claim 1, including means for regulating distribution of air flow from the plenum into the hollow tubes comprising an apertured air regulating disc secured to the inlet end of each of said hollow tubes having a hole sized to achieve a predetermined flow distribution into the tubes.

* * * * *